United States Patent [19]

Soutsos

[11] 4,396,038

[45] Aug. 2, 1983

[54] PIPE THREAD PROTECTORS AND METHOD FOR FORMING SAME

[76] Inventor: Michael D. Soutsos, 5475 Colorado St., Long Beach, Calif. 90814

[21] Appl. No.: 337,533

[22] Filed: Jan. 7, 1982

[51] Int. Cl.[3] ..... F16L 57/00

[52] U.S. Cl. ..... 138/96 T; 24/69 ST

[58] Field of Search ..... 138/96 R, 96 T; 403/344; 285/360, 361, 376, 396, 401, 402, 404, 407; 24/69 AT, 69 ST, 263 CA, 248 E, 19, 20 R

[56] References Cited

U.S. PATENT DOCUMENTS

| | | | |
|---|---|---|---|
| 1,074,706 | 10/1913 | Ferguson | 285/360 |
| 3,038,502 | 6/1962 | Hauk et al. | 138/96 T |
| 3,858,910 | 1/1975 | Oetiker | 285/376 |
| 3,876,234 | 4/1975 | Harms | 285/360 |
| 4,190,087 | 2/1980 | Herman et al. | 138/96 T |

*Primary Examiner*—John W. Shepperd
*Attorney, Agent, or Firm*—I. Michael Bak-Boychuk

[57] ABSTRACT

Set out herein are improvements to pipe thread protectors of the type described in U.S. Pat. No. 3,038,502 to Hauk et al., characterized by a band buried within a split torroidal envelope with the band ends being pulled together by a cam operated lever. It is the improved structure of the cam and the attached lever configuration resulting in manufacturing convenience that is set out herein. The cam is generally conformed as a cut out on the interior of a cylindrical sleeve which is provided with a release recess through which the lever may be inserted or withdrawn. These features permit the complete forming of the lever and the cam while separated thus allowing techniques like investment casting to be used for the construction thereof.

1 Claim, 4 Drawing Figures

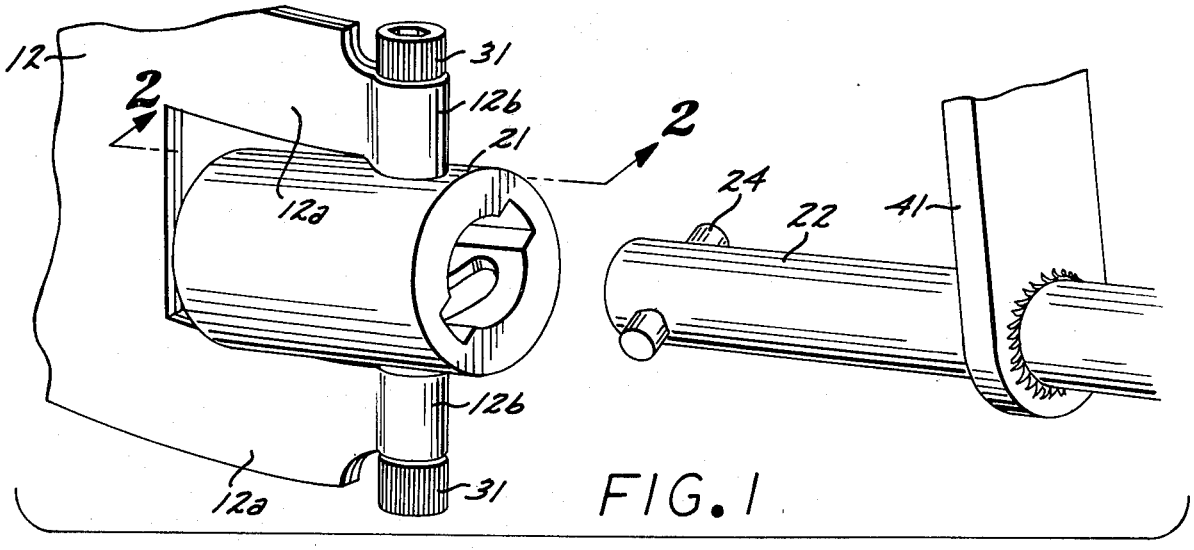
FIG. 1
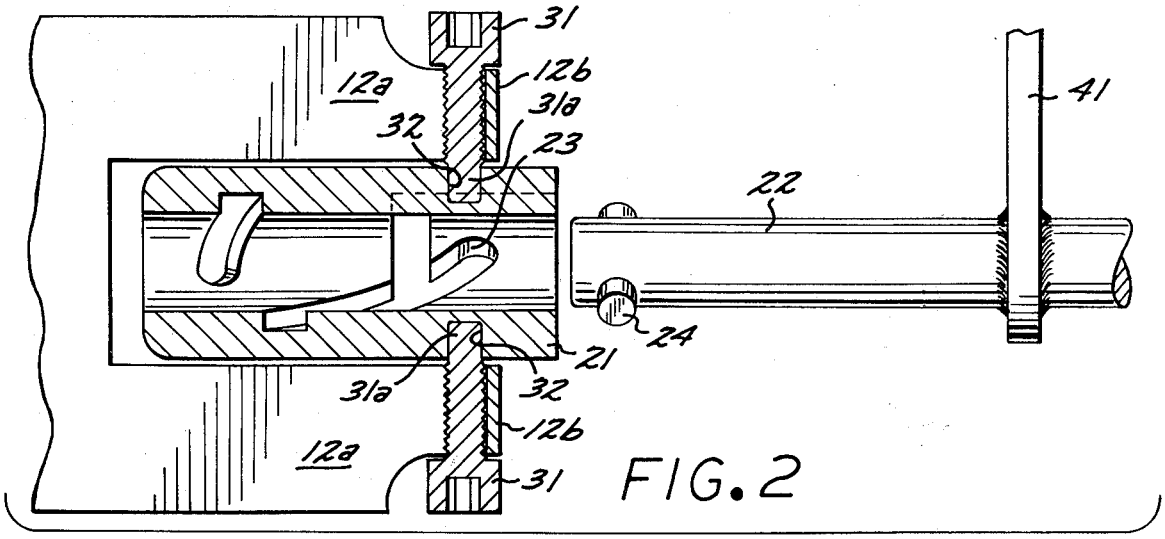
FIG. 2
FIG. 3
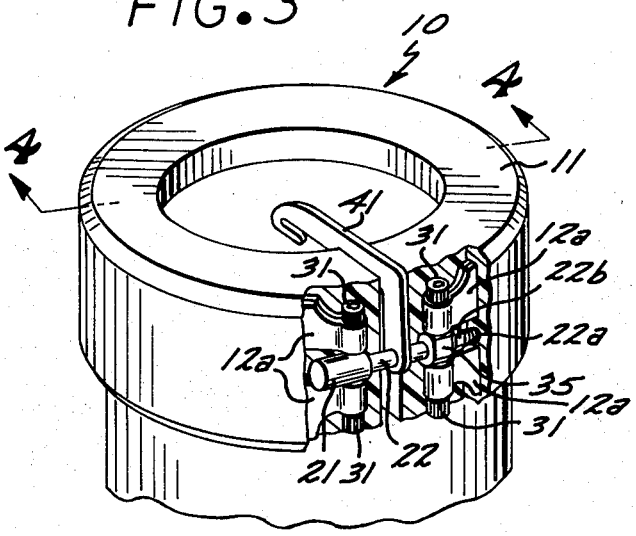
FIG. 4
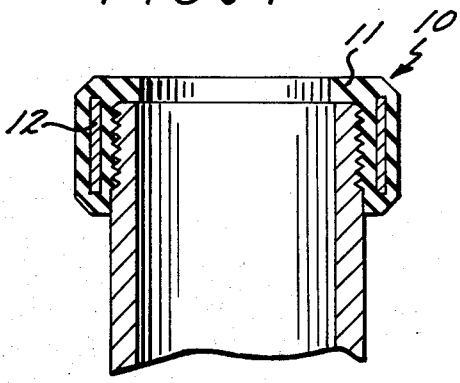

PIPE THREAD PROTECTORS AND METHOD FOR FORMING SAME

BACKGROUND OF THE INVENTION

1. Field of the Invention

The present invention relates to pipe thread protectors, and more particularly to pipe thread protectors conformed for clamping.

2. Description of the Prior Art

Pipe thread protectors are often used in oil well drilling to protect the end threads on drill pipe which is often exposed to extreme abuse and harsh handling. Within this area the pipe thread protector described in U.S. Pat. No. 3,038,502 has had wide acceptance. The pipe thread protector of this configuration while useful, requires elaborate manufacturing sequences which raise the cost and complexity thereof.

In particular, the pipe thread protector of the above configuration is characterized by a lever which rotates a shaft within the interior of a torroidal cam, the shaft being provided with a transverse pin which rides within a spiral cut-out in the cam structure. The necessary assembly sequence dictated by this configuration requires the insertion of the pin into the shaft after the shaft is assembled into the cam. Accordingly, separate manufacturing steps have to be expended, including the step of drilling the shaft for the transverse pin and furthermore opening of the cam cylinder for transverse insertion of the pin. As a result of this manufacturing sequence the cost of the article is increased and more importantly the strength of the cam sleeve is necessarily diminished.

SUMMARY OF THE INVENTION

Accordingly, it is the general purpose and object of the present invention to provide improvements in the assembly of a prior art thread protector.

Other objects of the invention are to provide improvements in the technique of forming cam sleeves.

Yet additional objects of the invention are to provide an improved pipe thread protector having parts conformed for investment casting.

Briefly, these and other objects of the present invention are accomplished by modifying the structure of a pipe protector of the type described in U.S. Pat. No. 3,038,502 to include a cylindrical cam sleeve having interior cam grooves provided with an insertion path. A rod conformed for rotary articulation by an orthogonal handle is formed to include laterally projecting posts dimensioned to be inserted into the insertion path and therethrough into the cam groove. In this manner both the cam cylinder or sleeve and the rod may be formed in a process known as investment casting simplifying the fabrication thereof. Once engaged the closed exterior of the cam sleeve adds strength to the structure, reducing the structural requirement heretofore found necessary in an open cam surface. Since the process of investment casting allows for complex shapes the manufacture of the shaft can be such that the orthogonal handle is concurrently formed. Thus further economies of manufacture may be achieved by virtue of the foregoing improvements.

BRIEF DESCRIPTION OF THE DRAWING

FIG. 1 is a perspective illustration, separated by parts, of a pipe thread protector conformed to include components constructed according to the invention herein;

FIG. 2 is a sectional view of a cam arrangement constructed according to the invention herein;

FIG. 3 is a perspective illustration of a pipe thread protector utilizing the inventive parts set out herein; and FIG. 4 is a sectional view taken along line 4—4 of FIG. 3.

DESCRIPTION OF THE SPECIFIC EMBODIMENT

As shown in FIGS. 1–4 a pipe thread protector, generally designated by the numeral 10, generally comprises an elastomeric torroidal casting 11 having buried on the interior thereof a cylindrical, thin walled, sheet metal strap 12. Both the casting and the strap are split along a common split to form an expansible structure into which the end of a pipe P may be inserted. This expansible structure is clamped about the periphery of pipe P by a clamping arrangement comprising a cam sleeve 21 into which a rod 22 is inserted. Cam sleeve 21 is of tubular configuration having formed on the interior surface thereof a spiral cam groove 23 conformed to receive transverse posts 24 formed on the exterior of the rod 22. Thus as the rod 22 is turned posts 24 travel up on the cam surface of the cam groove 23 reducing the split dimension to cinch the pipe thread protector onto the end of the pipes. In order to facilitate insertion of the cam posts 24 into the cam groove 23 an angulated insertion groove 25 is provided within the interior surface of sleeve 21, this insertion groove communicating to the exterior of the sleeve. It is contemplated to form the path of insertion of insertion groove 25 such that the surface of groove 23 pierced thereby is the unloaded surface of the spiral. The other end of rod 22 may be provided with a threaded segment **22*a* onto which a nut 22*b* is brought home to adjust the nominal level of separation. More specifically, strap 12 proximate the ends thereof is conformed to provide two finger-like extensions 12*a* achieved by folding over the sheet metal structure thereof into a resulting set of opposed loops 12*b*. The interior of these loops may be threaded for receipt of opposed pivot screws 31 which on their interior ends are machined down to a reduced diameter ending shown as pivots 31*a*. These pivots 31*a*, in turn, are insertable into opposed bores 32 formed in the exterior surface of the cam sleeve 21 on one end of the strap 12 and into similar bores formed in a pillow block 35 mounted in the other end of the strap. It is this pillow block that retains the threaded end of rod 22**, thus forming the necessary juncture between the two strap ends.

In use the nut **22*b* on rod 22 may be loosened to relieve all bending stress of the strap 12 and the rod may then be inserted into the interior of sleeve 22 with the cam posts 24 following the inlet groove to pass into the interior of cam groove 23. Once that engagement is achieved the nut 22*b* may be brought home onto thread 22*a*** to the desired level of separation.

This arrangement of grooves in the sleeve 21 thus allows for direct insertion of the rod provided with the cam posts into the sleeve interior. Accordingly, the sequence heretofore necessary by which a pin is inserted subsequent to rod insertion is avoided. Furthermore the resulting structure of rod 22 and sleeve 21 is uniquely conformed for investment casting adding further economies to the article. In particular investment casting is characterized by the use of wax patterns which are lost by heating or other process resulting in a cavity which is conformed for a complex shape. Thus the rod may be cast as an integral unit together with the cam posts 24 and an angulatetd handle 41 in a single sequence which may also entail the casting of the cam sleeve 21. The resulting structure is then easily assembled by virtue of the exteriorly opened insertion groove reducing the assembly sequence heretofore practiced to a minimal level.

Obviously many modifications and changes may be made to the foregoing description without departing from the spirit of the invention. It is therefore intended that the scope of the invention be determined solely on the claims appended hereto.

What is claimed is:

1. In a pipe thread protector characterized by a sheet metal strap convolved to form a tubular segment split along one lateral edge and encased in an elastomeric enclosure the adjacent ends of said strap forming said split being joined by a cam assembly comprising a threaded rod engaging a cylindrical retainer pivotally attached to one end and a cam sleeve pivotally attached to the other end and provided with a spiral cutout engaged by a pin passing transversely through said post, the improvement comprising:

said cam sleeve being conformed to include a tubular surface conformed to receive said rod on the interior thereof having a spiral groove formed on the interior thereof and a communicating passage extending from one end into the unloaded side of said groove, and said rod being provided with a transverse projection conformed to pass through said passage into said groove.

* * * * *